US005927195A

United States Patent [19]

Völz et al.

[11] Patent Number: 5,927,195

[45] Date of Patent: Jul. 27, 1999

[54] PRINTING MACHINE

[75] Inventors: Albrecht Völz, Rödermark; Joachim Blumör, Hainburg; Holger Wiese, Obertshausen; Helmut Schild, Steinback/Ts; Thomas Herrmann, Hanau; Klaus-Peter Reichardt, Bad Vilbel, all of Germany

[73] Assignee: MAN Roland Druckmaschinen AG, Germany

[21] Appl. No.: 08/984,607

[22] Filed: Dec. 3, 1997

[30] Foreign Application Priority Data

Dec. 3, 1996 [DE] Germany ..... 196 50 075

[51] Int. Cl.[6] ..... B41F 7/06; B41F 5/02; B41F 5/22

[52] U.S. Cl. ..... 101/183

[58] Field of Search ..... 101/183, 177, 101/181, 179, 180, 136, 137, 138, 139, 140, 142, 184; 226/2, 24, 27, 28, 30, 40, 42; 364/469.03, 469.04; 318/257, 67, 68

[56] References Cited

U.S. PATENT DOCUMENTS

| | | | |
|---|---|---|---|
| 4,581,993 | 4/1986 | Schoneberger | 101/217 |
| 4,980,623 | 12/1990 | Anton . | |
| 5,127,324 | 7/1992 | Palmatier et al. | 101/248 |
| 5,309,834 | 5/1994 | Koch . | |
| 5,377,589 | 1/1995 | Kruger et al. . | |
| 5,398,603 | 3/1995 | Hartmann | 101/183 |

FOREIGN PATENT DOCUMENTS

| | | |
|---|---|---|
| 0 355 442 B1 | 7/1989 | European Pat. Off. . |
| 26 37 795 | 12/1981 | Germany . |
| 41 02 472 | 8/1992 | Germany . |
| 42 14 394 | 11/1993 | Germany . |
| 42 28 506 | 3/1994 | Germany . |
| 42 41 807 | 6/1994 | Germany . |

*Primary Examiner*—J. Reed Fisher
*Attorney, Agent, or Firm*—Leydig, Voit & Maier, Ltd.

[57] ABSTRACT

A printing machine is disclosed, in particular a sheet-fed offset printing machine, in which a plurality of cylinders are coupled to one another via a continuous drive train, and at least two cylinders include a controllable drive. The controllable drive stresses the drive train in order affect the tooth-flank contact of the gear train, which affects the angular position of the printing cylinders. By controlling the angular positions of the printing cylinders, precise registration is maintained during dynamic changes in the load on the gear train during the printing process. More specifically, blanket cylinders in the printing machine are each coupled to a position-controllable drive, which is controlled by applying a preferred position value in such a way that the gear train placed between two drives is stressed by a predefined angular amount.

7 Claims, 3 Drawing Sheets

PRINTING MACHINE

FIELD OF THE INVENTION

This invention relates generally to a printing machine, and more particularly to a sheet-processing printing machine having a plurality of printing units.

BACKGROUND OF THE INVENTION

Printing machines, particularly sheet-fed offset printing machines, utilize drives, often in the form of direct current motors, to drive via a continuous gear train both the cylinders of the printing units and the cylinders or drums used in transporting printed material. Due to the large number of printing units in a printing machine, very high load torques are produced in the gear train which, in turn, produces torsion between the individual printing units. The resultant torsion causes doubling phenomena and registration differences to occur as a result of changes in the load on the gear train.

Furthermore, conventional sheet-fed offset printing machines that have a feed-in point driven by a drive motor require complicated mechanical components in order to change the mode of operation from face-side printing to perfecting and vice versa. A disadvantage in printing machines driven by a continuous gear train is that automated operations in the individual printing units must be carried out one after another because the individual processes require different directions of rotation and/or different rotation speeds. For example, automatic washing of blanket cylinders or printing cylinders is carried out separate from changing the printing forms or printing plates.

Disclosed in U.S. Pat. No. 5,377,589 (and corresponding German Patent DE 42 41 807 A1) is a drive for a printing press in which the effect of the drive train on synchronization is reduced for those elements of the printing machine which are not involved in transporting the printed material. According to the device, a first drive, which includes one or more motors, is provided for all cylinders serving the transport of printed material and for the plate cylinders which are connected to one another via a continuous gear train. The elements not serving the transport of printed material, such as the inking or damping solution units, are attached to separate drives which are executed in a position controlled manner in relation to operation of the cylinders. Synchronization of these mutually decoupled partial systems is accomplished by means of signals from sensors detecting movement of the various components and cylinders. Although the drive avoids some of the negative effects of torsion on the printing process, the plate cylinder of one printing unit is mechanically coupled via the continuous gear train to the other printing unit cylinders which results in load fluctuations being transferred directly to the plate cylinder. These load fluctuations, in turn, cause printing disturbances.

Disclosed in U.S. Pat. No. 5,309,834 (and corresponding German Patent DE 42 14 394 A1) is a rotary printing machine having a number of directly driven cylinders and at least one directly driven folding unit, wherein the individual drives of the cylinders and their drive controllers are combined to form printing-station groups. The printing-station groups, which are connected to one another and assigned to one of the folding units, receive their position reference from the folding unit. Management of the printing-station groups is performed by a high order control system. Applying this previously known solution to a sheet-fed offset printing machine allows each individual cylinder, including printing unit cylinders and cylinders or drums used for transporting printed material, to have a dedicated drive whose position can be controlled. While increased functionality is achieved, in particular for implementation of automated operations, the number of drives required to implement the configuration becomes highly cost-intensive. Furthermore, precautions must be taken to ensure that the sheet-guiding cylinders having gripper devices are capable of rotating relative to one another to the maximum permissible angular amount. Otherwise, damage will occur to the equipment of the gripper systems projecting away from the circumference of the cylinder.

Disclosed in U.S. Pat. No. 4,980,623 (and corresponding European Patent EP 0 355 442 B1) is a method and device for reducing torque loading on a system driven by means of an electric motor. According to the invention, changes in the load torque are counteracted by oppositely directed changes in the drive torque such that the load torque is maintained at an approximate constant value. Combining this method and device into a sheet-fed offset machine having a plurality of printing units, however, only minimizes the torsion produced by the load fluctuations and produces no gain in functionality.

Disclosed in German Patent DE 42 41 807 A1 is a method and drive for a printing machine having a plurality of printing units in which a plurality of drive motors drive a continuous gear train. According to the invention, a first drive motor feeds an excess of power into the drive train. The excess is proportioned to ensure a constant direction of power flow in the drive train. A final drive motor compensates for the excess power flow and regulates power flow through the entire drive train. In sheet-fed offset printing machines, use of this method and corresponding drive avoids tooth flank changes which result in uncontrollable stressing. The disadvantage of this method is that the angular position of the feed motors or of the cylinders driven by the motors is undefined resulting in an angular position strongly dependent on the phase and tolerance of the gear wheels.

SUMMARY OF THE INVENTION

The general objective of the present invention is to develop a printing machine, in particular a sheet-fed offset printing machine having a plurality of printing units, which improves the printing process, expands functionality, and increases cost-effectiveness of the configuration while avoiding the above mentioned disadvantages.

It is another objective of the present invention to reduce the number of discards produced during the printing process due to registration differences caused by torsion on the gear train and furthermore, to improve the quality of printed material, especially costly multi-color printed material.

It is a further objective of the present invention to control the drives in the individual printing units in such a way that different operations are capable of being performed simultaneously in the individual printing units.

According to the invention, the angular positions of the printing cylinders are controlled such that adequate stress is applied to the gear train allowing precise registration to be maintained during dynamic changes in the load on the gear train during the printing process.

It is a feature of the present invention, therefore, to couple the blanket cylinders, the back-pressure cylinders, the sheet-guiding cylinders and the drums to one another by a gear train and to run the plate cylinders mechanically decoupled from the blanket cylinders. It is another feature to couple separate position controllable drives to the blanket cylinders and the plate cylinders, and to control the drives via a controller. By means of the controller, the preferred position values for the drives of the blanket cylinders, including an angular offset, are applied to the drives which results in stressing the gear train by a predefined angular amount sufficient to maintain proper positioning of the cylinders.

Other features and advantages of the invention will be more readily apparent from the following detailed description of the preferred embodiment of the invention when taken in conjunction with the accompanying drawings wherein:

DETAILED DESCRIPTION OF THE PREFERRED EMBODIMENTS

Figure 1:
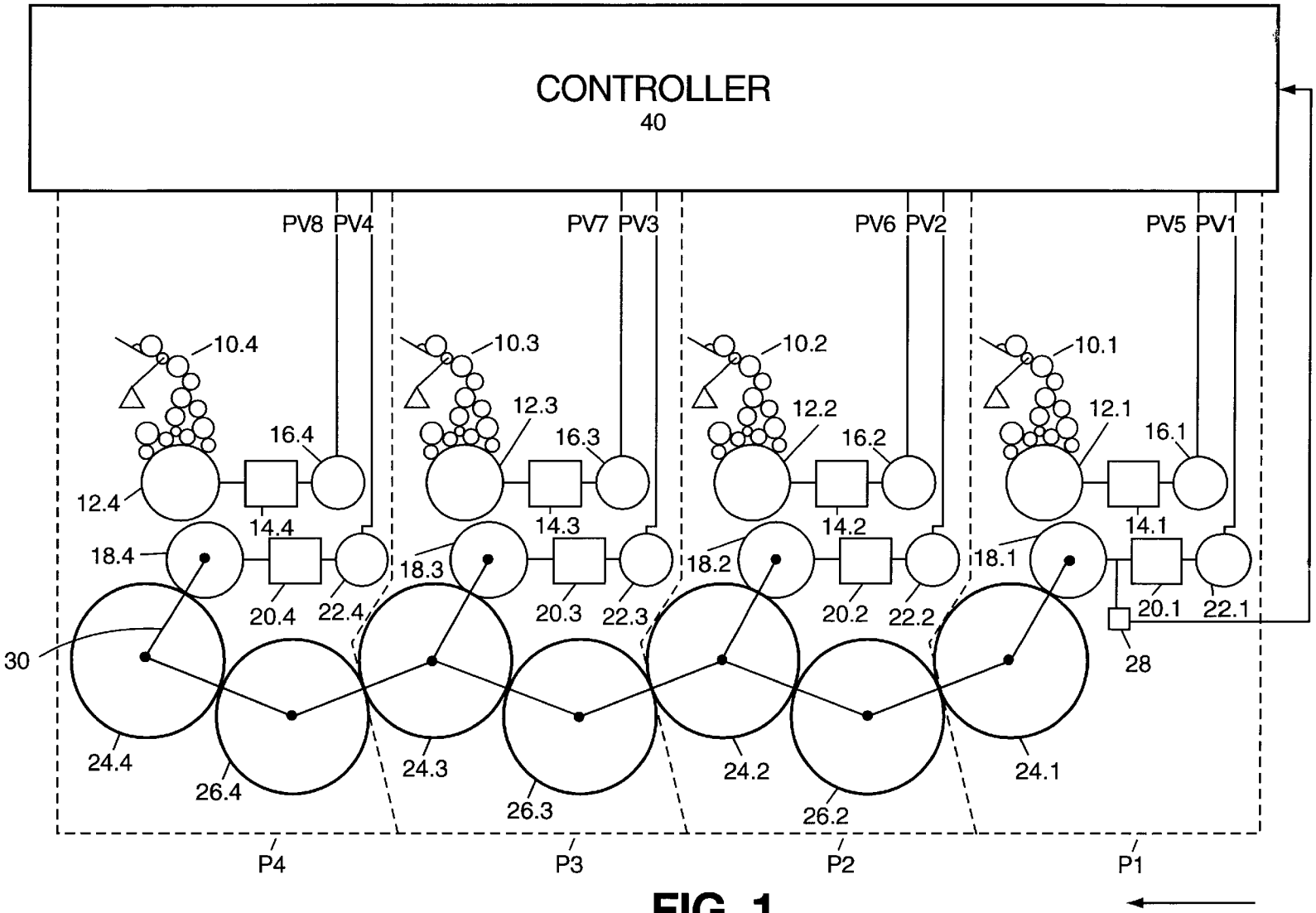
FIG. 1 is a diagrammatic representation of a sheet-fed offset printing machine with a plurality of printing cylinders coupled to one another via a continuous gear train.

Turning to the drawings, FIG. 1 illustrates an exemplary sheet-fed offset printing machine including four printing units P1, P2, P3, P4 with associated cylinders and drives wherein the path of the printed material follows the direction of the arrow, from right to left. Each printing unit shown includes a plate cylinder 12, a blanket cylinder 18, and a back-pressure cylinder 24 working together with the blanket cylinder 18. A transfer drum 26 is positioned between the back-pressure cylinders 24 of the individual printing units. The blanket cylinders 18, the back-pressure cylinders 24, and the transfer drums 26 are coupled to one another by a mechanical gear train 30.

As illustrated in the figure, the blanket cylinder 18 in each individual printing unit is coupled via a reduction gear 20 to a position-controllable drive 22. The plate cylinder 12 in each printing unit is likewise coupled via a reduction gear 14 to a position-controllable drive 16. The plate cylinder 12, however, runs mechanically decoupled from its associated blanket cylinder 18. This allows the plate cylinder 12 to be driven independently from the blanket cylinder 18 during certain automated operations. For example, it is possible to change the printing forms or printing plates in all four printing units simultaneously. It is also possible to change the printing forms or printing plates in one printing unit while simultaneously performing an automatic wash program on the blanket cylinder or back-pressure cylinder in another printing unit.

In the preferred embodiment, the inking and/or damping solution unit 10 in each individual printing unit runs mechanically coupled to its respective plate cylinder 12. To implement this configuration, individual applicator rolls in the inking and/or damping solution unit 10 have a positively-locking drive to the plate cylinder 12. The ductors in the inking and/or damping solution unit 10 preferably have their own controllable-speed drives (not depicted).

According to the invention, the position-controllable drives 16, 22 of the blanket cylinder 18 and the plate cylinder 12 are effectively connected to a controller 40. The controller 40 transmits the appropriate position values to the drives 16, 22 in order to properly adjust the cylinders. In the figure, the preferred position values for the blanket cylinders 18 are designated by PV1, PV2, PV3 and PV4. Similarly, preferred position values PV5, PV6, PV7, PV8 are applied to the position-controllable drives 16 of the plate cylinders 12 in order to synchronize the plate cylinders and the blanket cylinders for precise registration.

The preferred position values PV1, PV2, PV3, PV4 for the blanket cylinders 18 are chosen to be offset in relation to one another by an angular offset value. Upon applying the preferred position values, which include the angular offset, a stress occurs in the gear train 30 between the printing units due to the elasticity and tolerances present in the gear train 30. The angular offset between two successive blanket cylinders 18 is proportioned such that tooth-flank play in between the cylinders 18, 24, 26 is removed for any angular position in the gear train 30. The angular offset is also dependent on the rolling tolerance and distributed torques in the gear train 30 between two blanket cylinders 18.

Figure 3:
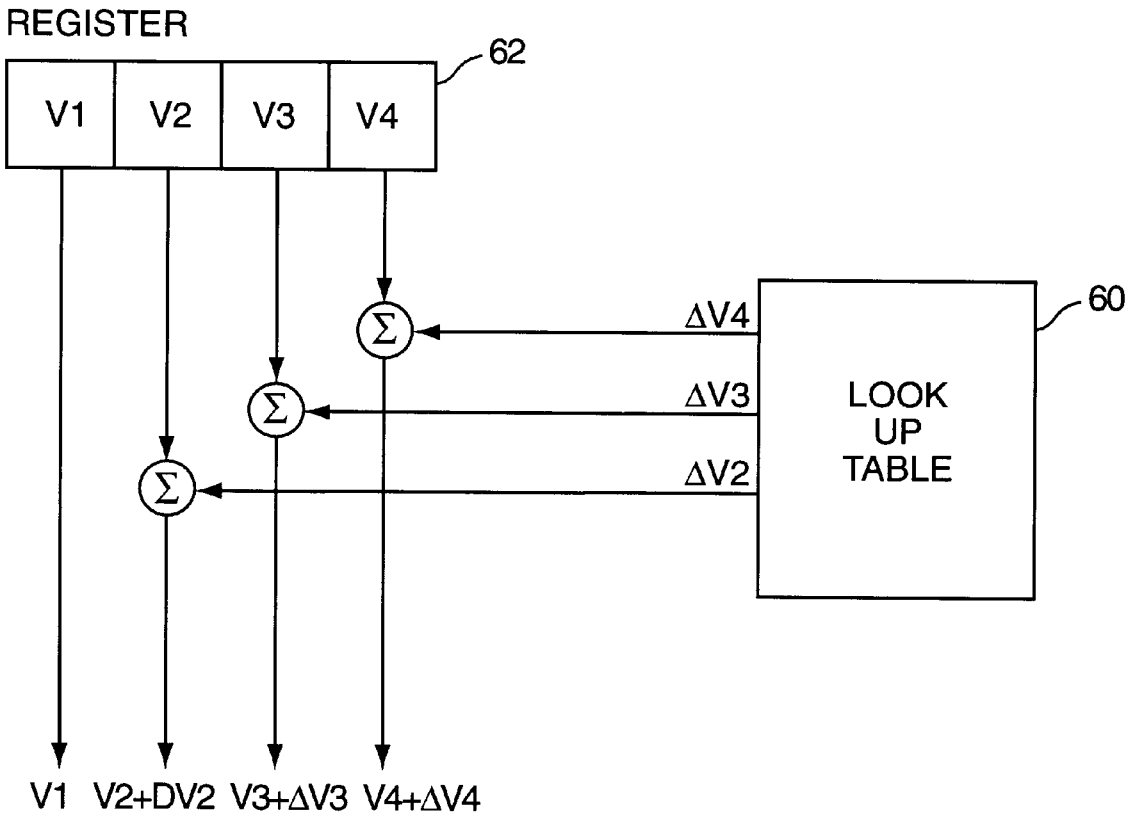
FIG. 3 is a block diagram of a portion of the controller depicted in FIG. 2.

In one embodiment of the invention, the angular offset values are determined and set individually for each printing unit in the printing machine based on detected tolerances. These angular offset values are stored as a specific offset value by the controller 40 in a look up table 50, as depicted in FIG. 3. In another embodiment of the invention, the offset values are uniform and predefined to be sufficiently large for each printing machine. The predefined angular offset values are similarly stored by the controller 40 in a look up table 50.

According to the invention, the drives 22 assigned to the blanket cylinders 18 are generated by a real or virtual master shaft. In one preferred embodiment, the preferred position values PV1, PV2, PV3, PV4 are determined by monitoring the actual (real) movement of the cylinders 18. As shown in FIG. 1, a position transmitter 28 is situated to receive actual position values from the blanket cylinder 18.1 in the first printing unit P1. The actual position values are transmitted to the controller 40 for evaluation. The controller 40 generates the preferred position value PV1 for the drive 22.1 of the blanket cylinder 18.1 in the first printing unit P1 based on the predefined rotational speed of the blanket cylinder 18.1. The controller 40, then, evaluates and generates the preferred position values PV2, PV3, PV4 for the remaining drives 22.2, 22.3, 22.4 based on the actual position value transmitted by the position transmitter 28. According to the invention, an angular offset is selected and applied to the actual position values in order to stress the gear train 30 between blanket cylinders 18. The angular offset selected can be uniform or distinct for each printing unit in the printing machine.

In another embodiment of the invention, a virtual master shaft control is implemented wherein preferred position values PV1, PV2, PV3, PV4 are applied to the blanket cylinders 18 based on a predefined command to the printing machine. For example, the predefined position values may be based on the predefined operating speed of the printing machine. In this embodiment, an angular offset is similarly applied to the predefined position values as required to stress the gear train 30. In this design, the predefined position values utilized by the controller 40 are generated by a virtual master shaft.

The following analysis explains generally the steps required to implement the invention in a printing machine with four printing units. First, actual position values are transmitted from the position transmitter 28 to the controller 40. The controller 40 then determines the preferred position value PV2 in the second printing unit such that the drive 22.2 of the blanket cylinder 18.2 stresses the gear train 30 between the drive 22.1 of the blanket cylinder 18.1 in the first printing unit P1 and the blanket cylinder 18.2 in the second printing unit P2 by a predefined angular amount. Similarly, the controller 40 next determines the position values PV3, PV4 in order to stress the gear train 30 between the second printing unit P2 and the third printing unit P3, and between the third printing unit P3 and the fourth printing unit P4, respectively, by a predefined angular amount.

More specifically, the preferred position value PV2 determined by the controller 40 for the second printing unit P2 is represented by:

$$PV2=V2+\Delta V2$$

where V2 represents the geometrically preferred position value given stress-free operation of the cylinders and ΔV2 represents the angular offset value necessary to apply the appropriate stress on the gear train between the blanket cylinders 18. The angular offset value can be either positive or negative.

The preferred position values PV3, PV4 determined by the controller 40 for the third and fourth printing units P3, P4 are represented respectively by:

$$PV3=V3+\Delta V3$$

$$PV4=V4+\Delta V4$$

Finally, since no stressing of the gear train is required in the first printing unit, the angular offset, ΔV1, is equal to zero and the preferred position value PV1 applied to the drive 22.1 of the first printing unit P1 is simply equal to V1. The angular offset values ΔV2, ΔV3 and ΔV4 applied to enable the position-controlled stressing of the gear train between two successive blanket cylinders in the second, third and fourth printing units can be of equal size or unequal size.

Figure 2:
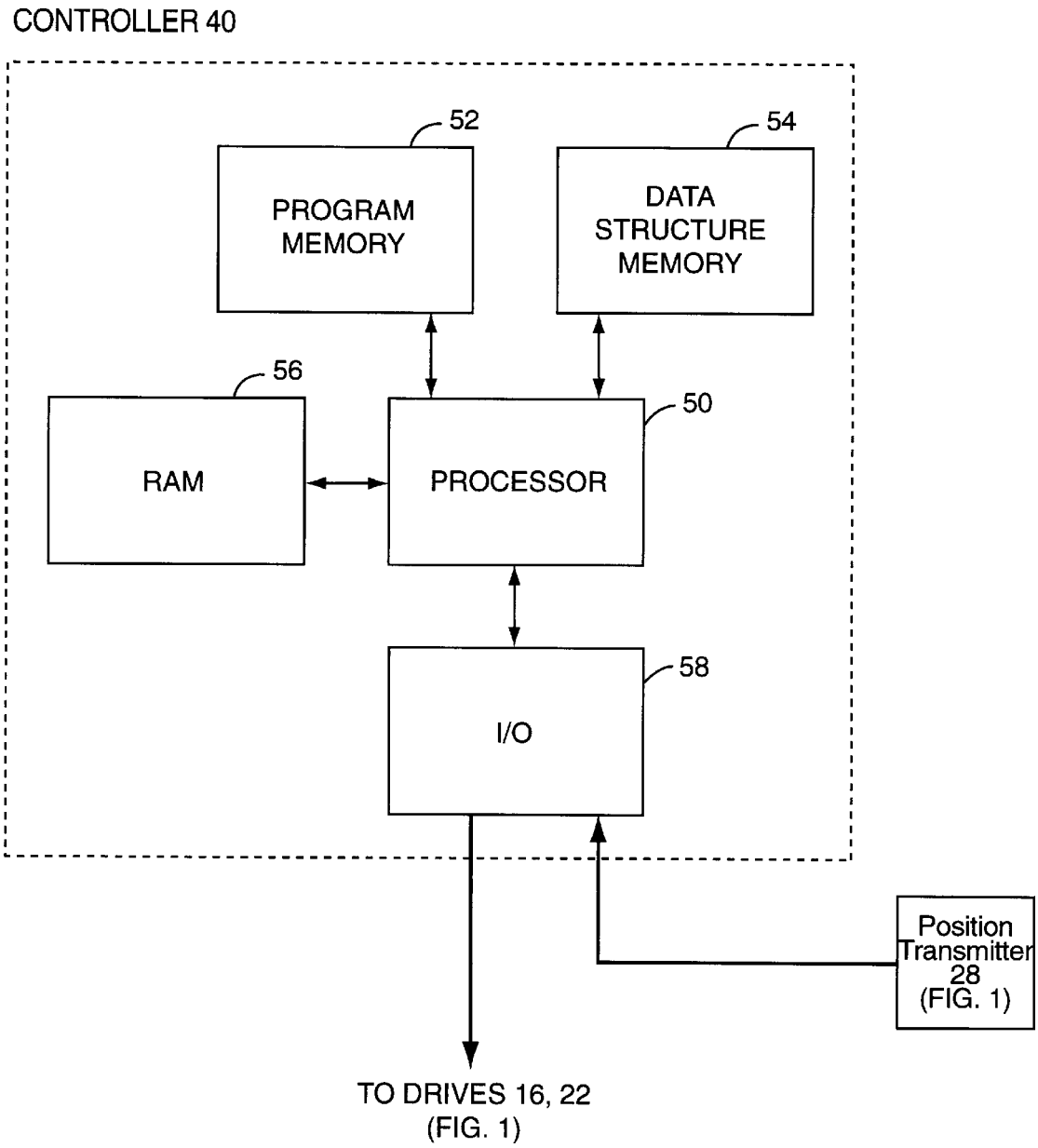
FIG. 2 is a block diagram of a controller for the drives of a sheet-fed offset printing machine.

FIG. 2 is a block diagram representation of an exemplary controller 40 used to implement the previous equations. The exemplary controller 40 comprises a processor 50, program memory 52, data structure memory 54, random access memory (RAM) 56, and an input/output device 58. As shown, position data is input through the input/output device 58 from the position transmitter 28 depicted in FIG. 1. The input/output device 58 is connected to the processor 50 and comprises the means to input relevant input data, for example, the angular position of the blanket cylinder. Once received, the position data is held by a register in the RAM 56. The data structure memory 54 stores the set of angular offset values Δ2, Δ3, Δ4 used to stress the gear train 30. The program memory 52 comprises the software to implement the above-described drive control process. The processor 50 processes the position data as instructed by the software and outputs the preferred position values to the drives 16, 22 depicted in FIG. 1.

Shown in FIG. 3 is a block diagram representation of a portion of the controller 40 depicted in FIG. 2 which further explains implementation of the equations. The controller 40 comprises a look up table 60 and a register 62. The register 62, stored in the RAM 56, holds the position values V1, V2, V3, V4 preferred given stress-free operation of the blanket cylinders 18. The look up table, stored in data structure memory 54, stores a set of angular offset values Δ2, Δ3, Δ4 applicable for use in stressing the gear train 30 to achieve proper positioning and speed. The position values V1, V2, V3, V4 held in the register 62 are then summed with the appropriate angular offset values Δ2, Δ3, Δ4 to generate the preferred position values PV1, PV2, PV3, PV4.

Although the invention has been described in connection with certain embodiments, there is no intent to in any way limit the invention to those embodiments. On the contrary, the intent is to cover all alternatives, modifications, and equivalents included within the spirit and scope of the invention as defined by the appended claims.

We claim:

1. A printing machine comprising:

a plurality of printing units each having a blanket cylinder and a plate cylinder;

a continuous drive train coupled to each of the blanket cylinders;

a control system;

a plurality of sensors each associated with one of the blanket cylinders, each sensor providing a position signal to the control system that generally describes the position of its associated blanket cylinder;

a plurality of position-controllable drives each associated with one of the blanket cylinders, each position-controllable drive being responsive to the control system for driving its respective blanket cylinder at an angular position that synchronizes each of the blanket cylinders with a respective one of the plate cylinders to provide a precise registration therebetween; and the control system further including a means for maintaining the precise registration between the blanket cylinders and the plate cylinders while mechanically stressing the drive train.

2. The printing machine according to claim 1, wherein the position-controlled drive coupled to the blanket cylinder is also coupled to a reduction gear.

3. The printing machine according to claim 1, wherein each of the plate and blanket cylinders is coupled to separate ones of the position-controllable drives.

4. The printing machine according to claim 3, wherein the drive coupled to the plate cylinder is also coupled to a reduction gear.

5. The printing machine according to claim 1, wherein inking units working together with the cylinders are mechanically coupled to the cylinders.

6. The printing machine according to claim 1, wherein the position-controllable drives are controlled by the control system through the application of preferred position values that are calculated by the control system based on actual position values generated by at least one position transmitter fitted to the printing machine.

7. The printing machine according to claim 1, wherein the position-controllable drives are controlled by the control system through the application of preferred position values that are calculated by the control system based on predefined running commands from a reference variable that is generated by the control system.

* * * * *